US009927146B2

(12) United States Patent
Teerling et al.

(10) Patent No.: US 9,927,146 B2
(45) Date of Patent: Mar. 27, 2018

(54) HEAT EXCHANGER

(71) Applicant: BEKAERT COMBUSTION TECHNOLOGY B.V., AR Assen (NL)

(72) Inventors: Omke Jan Teerling, PG 't Harde (NL); Raymond Westers, RS Nieuwe Pekela (NL); Geeske Berga, AW Groningen (NL); Marco Kauw, PG Garmerwolde (NL)

(73) Assignee: BEKAERT COMBUSTION TECHNOLOGY B.V., Assen (NL)

( * ) Notice: Subject to any disclaimer, the term of this patent is extended or adjusted under 35 U.S.C. 154(b) by 0 days.

(21) Appl. No.: 15/517,224

(22) PCT Filed: Oct. 5, 2015

(86) PCT No.: PCT/EP2015/072885

§ 371 (c)(1),
(2) Date: Apr. 6, 2017

(87) PCT Pub. No.: WO2016/055392

PCT Pub. Date: Apr. 14, 2016

(65) Prior Publication Data

US 2017/0241667 A1 Aug. 24, 2017

(30) Foreign Application Priority Data

Oct. 8, 2014 (EP) ..... 14188118

(51) Int. Cl.
*F28D 7/02* (2006.01)
*F24H 9/00* (2006.01)
(Continued)

(52) U.S. Cl.
CPC ..... *F24H 9/0015* (2013.01); *F24H 1/32* (2013.01); *F28D 1/0478* (2013.01);
(Continued)

(58) Field of Classification Search
CPC ..... F24H 9/0015; F24H 1/32; F28D 1/0478; F28D 1/05358; F28D 21/007; F28F 1/124; F28F 9/0221; F28F 2255/14
(Continued)

(56) References Cited

U.S. PATENT DOCUMENTS 4,579,163 A * 4/1986 Maendel ..... F24F 12/001 165/145
4,945,010 A * 7/1990 Kaufman ..... H01M 8/04007 165/172
(Continued)

FOREIGN PATENT DOCUMENTS

DE 102 36 665 2/2003
EP 1 028 298 8/2000
(Continued)

OTHER PUBLICATIONS

International Search Report dated Dec. 22, 2015 in International (PCT) Application No. PCT/EP2015/072885.

*Primary Examiner* — Justin Jonaitis
(74) *Attorney, Agent, or Firm* — Wenderoth, Lind & Ponack, L.L.P.

(57) ABSTRACT

The heat exchanger comprises at least one gas flow channel, at least one water flow channel, and a metal wall delimiting the gas flow channel from the water flow channel. The at least one water flow channel comprises a number of consecutive parallel straight segments. Two consecutive parallel straight segments are separated by a wall and by a U-turn comprising an upstream section and a downstream section. The upstream and the downstream sections are defined as the sections of the U-turn delimited on the one hand by the plane of the wall separating the two consecutive parallel straight segments; and on the other hand by the plane through the end section of the wall separating the two consecutive parallel straight segments, the plane which is
(Continued)

parallel with the width direction of the water flow channel and which is perpendicular to the plane of the wall separating the two consecutive parallel straight segments. In at least two U-turns the upstream section has a volume that is at least 20% lower than the volume of the downstream section.

11 Claims, 4 Drawing Sheets

(51) Int. Cl.

| | |
|---|---|
| ***F28D 21/00*** | (2006.01) |
| ***F24H 1/32*** | (2006.01) |
| ***F28F 9/02*** | (2006.01) |
| ***F28D 1/047*** | (2006.01) |
| ***F28D 1/053*** | (2006.01) |
| ***F28F 1/12*** | (2006.01) |

(52) U.S. Cl.
CPC ..... *F28D 1/05358* (2013.01); *F28D 21/0007* (2013.01); *F28F 1/124* (2013.01); *F28F 9/0221* (2013.01); *F28F 2255/14* (2013.01)

(58) Field of Classification Search
USPC ..... 165/165, 164, 166, 167, 177
See application file for complete search history.

(56) References Cited

U.S. PATENT DOCUMENTS

| | | | | |
|---|---|---|---|---|
| 5,697,433 | A * | 12/1997 | Kato | F28D 1/0316 165/153 |
| 6,026,890 | A * | 2/2000 | Akachi | F28D 15/0233 165/104.26 |
| 2007/0261815 | A1* | 11/2007 | Melby | F02B 29/0462 165/41 |
| 2010/0095701 | A1* | 4/2010 | Strunk | F25B 13/00 62/324.6 |
| 2010/0193169 | A1* | 8/2010 | Yamada | F28D 9/005 165/167 |
| 2010/0242863 | A1* | 9/2010 | Hubau | B22D 19/0063 122/367.1 |
| 2010/0258285 | A1* | 10/2010 | Yao | F28D 9/0037 165/167 |
| 2015/0300755 | A1* | 10/2015 | Takimoto | F28F 3/046 165/177 |

FOREIGN PATENT DOCUMENTS

| | | |
|---|---|---|
| EP | 1 669 689 | 6/2006 |
| GB | 1 425 473 | 2/1976 |

* cited by examiner

HEAT EXCHANGER

TECHNICAL FIELD

The invention relates to the field of heat exchangers for heating water by means of a flow of hot gas, e.g. flue gas. The flue gas can be generated by a burner integrated in a combustion chamber which can be provided in the heat exchanger.

BACKGROUND ART

US2010/0242863A1 describes a heat exchanger comprising walls out of aluminum. The walls enclose at least one water carrying channel and have at least one flue gas draft. At least one wall forms a boundary between the water carrying channel and the flue gas draft. The at least one wall is provided with fins and/or pins which enlarge the heat-exchanging surface and which extend in the flue gas draft. The heat exchanger has at least one water carrying channel comprising a number of consecutive parallel straight segments separated by U-turns. The heat exchanger comprises a combustion chamber for installation of a burner to generate flue gas.

EP16696892A2 discloses a heat exchanger that has a water carrying channel comprising a number of consecutive parallel straight segments separated by U-turns. The U-turns comprise deviating elements positioned in the water flow channel to deviate the water flow. The deviating elements extend over the whole length of a segment of a U-turn and correspond with the contour of the wall of the U-turn. The deviating elements are said to provide a more uniform water flow and a reduction of the pressure drop in the water channel.

GB1425473A discloses a sectional heat exchanger, particularly for use in gas or oil fired water heaters, made up of a plurality of side-by-side heat exchange units each comprising a pair of header sections interconnected by one or more finned tubes. Each header section is formed with an internal tapered socket at one end and an externally tapered surface at the opposite end, the ends of adjacent header sections being aligned and interfittingly received one within the other to define common supply and discharge headers. Each tube is in the form of a U-tube having straight portions connected by a return bend.

DISCLOSURE OF INVENTION

The primary objective of the invention is to provide a heat exchanger for heat exchange from a hot gas to water; and that has reduced pressure drop in the water flow channel or channels.

The first aspect of the invention is a heat exchanger. The heat exchanger comprises at least one gas flow channel for the flow of hot gas. The heat exchanger further comprises at least one water flow channel for the flow of water. The heat exchanger further comprises a metal wall delimiting the gas flow channel from the water flow channel, for exchanging heat between the hot gas in the gas flow channel and water in the water flow channel in order to heat the water. The at least one water flow channel comprises a number of consecutive parallel straight segments, wherein two consecutive parallel straight segments are separated by a wall and by a U-turn. The U-turn comprises an upstream section and a downstream section. The upstream and the downstream sections are defined as the sections of the U-turn delimited on the one hand by the plane of the wall separating the two consecutive parallel straight segments; and on the other hand by the plane through the end section of the wall separating the two consecutive parallel straight segments, the plane which is parallel with the width direction of the water flow channel and which is perpendicular to the plane of the wall separating the two consecutive parallel straight segments. The upstream section is located in the upstream part of the U-turn; and the downstream section is located in the downstream part of the U-turn. In at least two U-turns the upstream section has a volume that is at least 20% (and preferably at least 25%, more preferably at least 30%, even more preferably at least 35%) lower than the volume of the downstream section.

The inventive heat exchanger showed during its use a considerably reduced pressure drop in its water flow channels.

The heat exchanger comprises at least one gas flow channel for the flow of hot gas, at least one water flow channel for the flow of water; and a metal wall delimiting the gas flow channel from the water flow channel, for exchanging heat between the hot gas in the gas flow channel and water in the water flow channel in order to heat the water. Preferably, the metal wall is a cast wall. Preferably the metal wall is out of aluminum or out of an aluminum alloy. Preferably the metal wall comprises at the side of the gas flow channel pins and/or fins to increase the heat exchanging surface.

Preferably, the heat exchanger is suited for use in a condensing heat cell.

Preferably, the heat exchanger is an aluminum or aluminum alloy heat exchanger.

In a preferred heat exchanger, the water flow channel is provided via one or more casted metal parts, more preferably via one or more aluminum or aluminum alloy casted parts.

Preferably, in at least two consecutive U-turns the upstream section has a volume that is at least 20% (and preferably at least 25%, more preferably at least 30%, even more preferably at least 35%) lower than the volume of the downstream section.

Preferably, in at least three—preferably consecutive—U-turns the upstream section has a volume that is at least 20% (and preferably at least 25%, more preferably at least 30%, even more preferably at least 35%) lower than the volume of the downstream section.

Preferably, in at least four—preferably consecutive—U-turns the upstream section has a volume that is at least 20% (and preferably at least 25%, more preferably at least 30%, even more preferably at least 35%) lower than the volume of the downstream section.

In a preferred heat exchanger, the at least one water flow channel is provided for counter flow with respect to the at least one gas flow channel.

In a preferred embodiment, the wall separating two consecutive parallel straight segments of the water flow channel is a common wall, preferably out of metal, more preferably out of aluminum or out of an aluminum alloy. With "the two consecutive parallel straight segments of the water flow channel are separated by a common wall" is meant that water in each of the two consecutive parallel straight segments of the water flow channel contact each a side of the common wall. Preferably the common wall is a solid metal wall, preferably out of aluminum or out of an aluminum alloy.

In a preferred embodiment, the width of the parallel straight segment immediately downstream of the U-turn is smaller than the width of the parallel straight segment immediately upstream of the U-turn; and/or the height of the parallel straight segment immediately downstream of the U-turn is smaller than the height of the parallel straight segment immediately upstream of the U-turn.

In a preferred embodiment, for the parallel straight segments between at least three consecutive U-turns, the downstream parallel straight segment has a longer length than the upstream parallel straight segment.

In a preferred embodiment, the cross sectional area of the parallel straight segment immediately downstream of the U-turn is smaller than the cross section area of the parallel straight segment immediately upstream of the U-turn.

In a preferred embodiment, the cross section of the parallel straight segment immediately downstream of the U-turn has a substantially rectangular cross section; wherein the ratio of the largest over the smallest side of the substantially rectangular cross section is less than 1.5; preferably less than 1.3. The additional feature of such embodiments synergistically contributes to the reduction of the pressure drop in the water flow channel. Preferably the largest side of the substantially rectangular cross section is the height of the water channel; and the smallest side of the substantially rectangular cross section is the width of the water channel.

In a preferred embodiment, in a second U-turn in the water flow channel the relative difference in volume between the downstream section and the upstream section is more than 20%, but is smaller than the relative difference in volume between the downstream section and the upstream section in a first U-turn upstream in the water flow channel to the second U-turn. The relative difference is defined as the volume of the downstream section minus the volume of the upstream section, divided by the volume of the downstream section. This embodiment synergistically adds to the performance of the heat exchanger. In preferred heat exchangers having counter flow of the gas flow channel with respect to the water flow channel, the embodiment solves the risk of overheating the metal walls of the heat exchanger in the sections where the temperature of the hot gas is highest.

In a preferred embodiment, the heat exchanger comprises a series of U-turns. In each U-turn in the series of U-turns, the relative difference in volume between the downstream section and the upstream section of the U-turn is more than 20%. In the series of U-turns the relative difference in volume between the downstream section and the upstream section of the U-turn decreases in downstream direction of the water flow channel. Preferably the series comprises at least 3 U-turns, more preferably at least 4 U-turns, even more preferably at least 5 U-turns. Preferably, the U-turns in the series of U-turns are consecutive U-turns. Heat exchangers according to such embodiments provide better functionality. In preferred heat exchangers having counter flow of the gas flow channel with respect to the water flow channel, the embodiment solves the risk of overheating the metal walls of the heat exchanger in the sections where the temperature of the hot gas is highest.

In a preferred heat exchanger, the water flow channel comprises downstream of the U-turns wherein the volume of the upstream section is at least 20% lower than the volume of the downstream section, at least one U-turn (and preferably at least two U-turns, more preferably at least three U-turns) wherein the upstream section has a substantially equal or a larger volume than the downstream section. Heat exchangers according to such embodiments provide better functionality. In preferred heat exchangers having counter flow of the gas flow channel with respect to the water flow channel, this embodiment solves the risk of overheating the metal walls of the heat exchanger in the sections where the temperature of the hot gas is highest.

In an embodiment of the invention, the heat exchanger is a sectional heat exchanger. The sectional heat exchanger comprises two end segments and one or more intermediate segment(s) provided between the two end segments. The one or more intermediate segment(s) and the two end segments are assembled in the heat exchanger. A combustion chamber is provided in the sectional heat exchanger, preferably perpendicular to the one or more intermediate segment(s). Each of the one or more intermediate segments comprises at least one water flow channel. In between each two consecutive segments at least one gas flow channel is present, and the gas flow channel extends from at the combustion chamber. At least one intermediate segment, and preferably each intermediate segment—and preferably also the two end segments—comprise at least one water flow channel comprising a number of consecutive parallel straight segments, wherein two consecutive parallel straight segments are separated by a wall and by a U-turn. The U-turn comprises an upstream section and a downstream section. The upstream and the downstream sections are defined as the sections of the U-turn delimited on the one hand by the plane of the wall separating consecutive parallel straight segments; and on the other hand by the plane through the end section of the wall separating consecutive parallel straight segments, the plane which is parallel with the width direction of the water flow channel and which is perpendicular to the plane of the wall separating consecutive parallel straight segments. The upstream section is located in the upstream part of the U-turn; and the downstream section is located in the downstream part of the U-turn. In at least two (and preferably in at least three, more preferably in at least four) U-turns (and preferably in at least two consecutive U-turns, more preferably in at least three consecutive U-turns, even more preferably in at least four consecutive U-turns) the upstream section has a volume that is at least 20% (and preferably at least 25%, more preferably at least 30%, even more preferably at least 35%) lower than the volume of the downstream section. The mentioned preferred features of the different sub-embodiments of this embodiment can be combined with each other while staying within the scope of the invention.

In a preferred embodiment, the heat exchanger is a mono-cast metal heat exchanger, e.g. out of aluminum or out of an aluminum alloy.

A preferred heat exchanger comprises a combustion chamber for the installation of a burner, preferably for the installation of a premix gas burner, more preferably a surface stabilized premix gas burner.

In a preferred heat exchanger the outer part of the upstream section of the U-turn comprises a curved section with smallest radius of curvature R1; and the outer part of the downstream section of the U-turn comprises a curved section with smallest radius of curvature R2. The smallest radius of curvature R2 is at least 20 mm; and preferably at least 25 mm. The ratio of R1/R2 is higher than 1.5; preferably higher than 1.66; more preferably higher than 2; more preferably higher than 2.33; more preferably higher than 2.66; more preferably higher than 3.

A second aspect of the invention is a heat cell comprising a heat exchanger as in any embodiment of the first aspect of the invention. The heat exchanger comprises a combustion chamber. A burner, preferably a premix gas burner, more preferably a surface stabilized premix gas burner, is provided in the combustion chamber of the heat exchanger. Preferably, the heat cell is a condensing heat cell. Preferably, the heat cell comprises a condensation sump to collect condensate from the flue gas generated in the heat exchanger.

A third aspect of the invention is a boiler, comprising a heat exchanger as in the first aspect of the invention or a heat cell as in the second aspect of the invention. Preferably, the boiler is a condensing boiler. Preferably, the heat cell comprises a condensation sump to collect condensate from the flue gas generated in the heat exchanger.

MODE(S) FOR CARRYING OUT THE INVENTION

Figure 1:
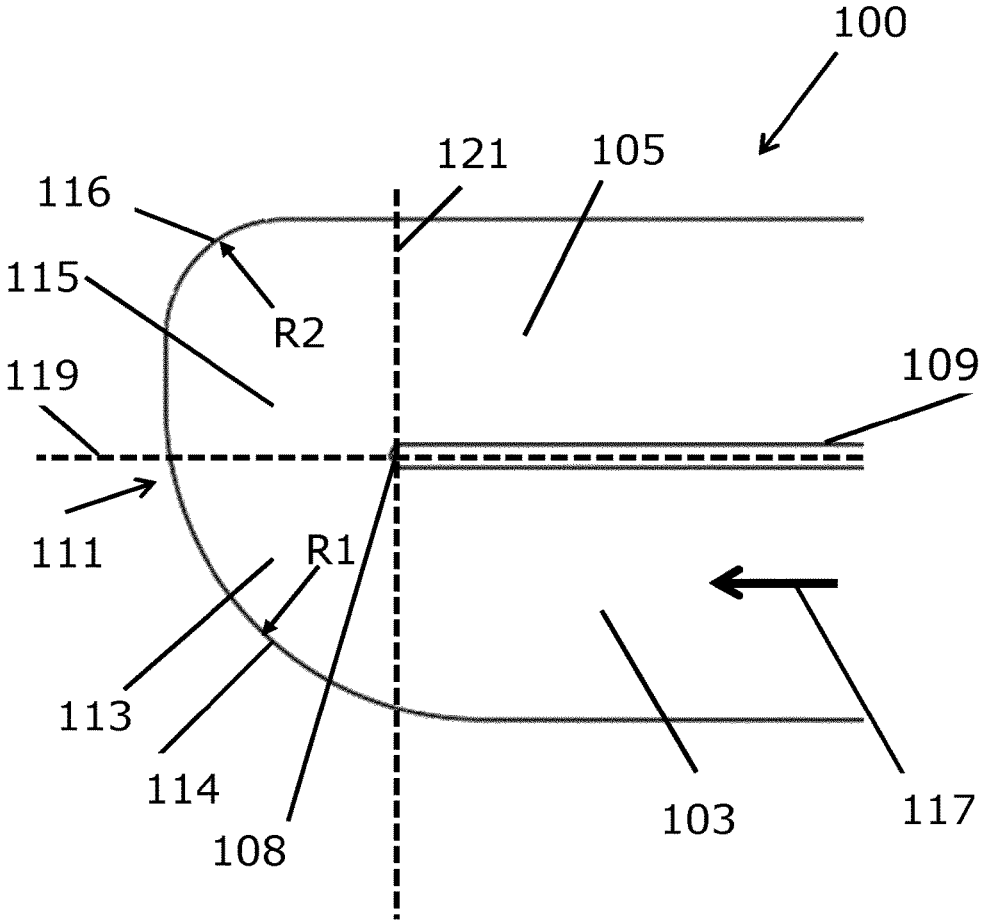
FIG. 1 shows the cross section of a part of a water flow channel of an inventive heat exchanger.

FIG. 1 shows the cross section of a part of a water flow channel 100 of an inventive heat exchanger. FIG. 1 shows two consecutive parallel straight segments 103, 105 of the water flow channel 100. The two consecutive parallel straight segments 103, 105 are separated by a wall 109 and by a U-turn 111. The U-turn 111 comprises an upstream section 113 and a downstream section 115. The direction of flow of the water when the heat exchanger is in operation is shown by arrow 117. The upstream section 113 and the downstream section 115 are defined as the sections of the U-turn 111 delimited on the one hand by the plane 119 of the wall 109 separating consecutive parallel straight segments (103 and 105); and on the other hand by the plane 121 through the end section 108 of the wall 109 separating consecutive parallel straight segments (103 and 105), the plane 121 which is parallel with the width direction of the water flow channel 100 and which is perpendicular to the plane of the wall 109 separating the two consecutive parallel straight segments (103 and 105). The upstream section 113 is located in the upstream part of the U-turn 111. The downstream section 115 is located in the downstream part of the U-turn 111. FIG. 1 shows a cross section of the water flow channel. It has to be understood however that the upstream section 113 and downstream section 115 are volumes and not surfaces. The outer part 114 of the upstream section 113 of the U-turn 111 comprises a curved section with smallest radius of curvature R1 (see FIG. 1); and the outer part 116 of the downstream section 115 of the U-turn 111 comprises a curved section with smallest radius of curvature R2 (see FIG. 1).

Figure 2:
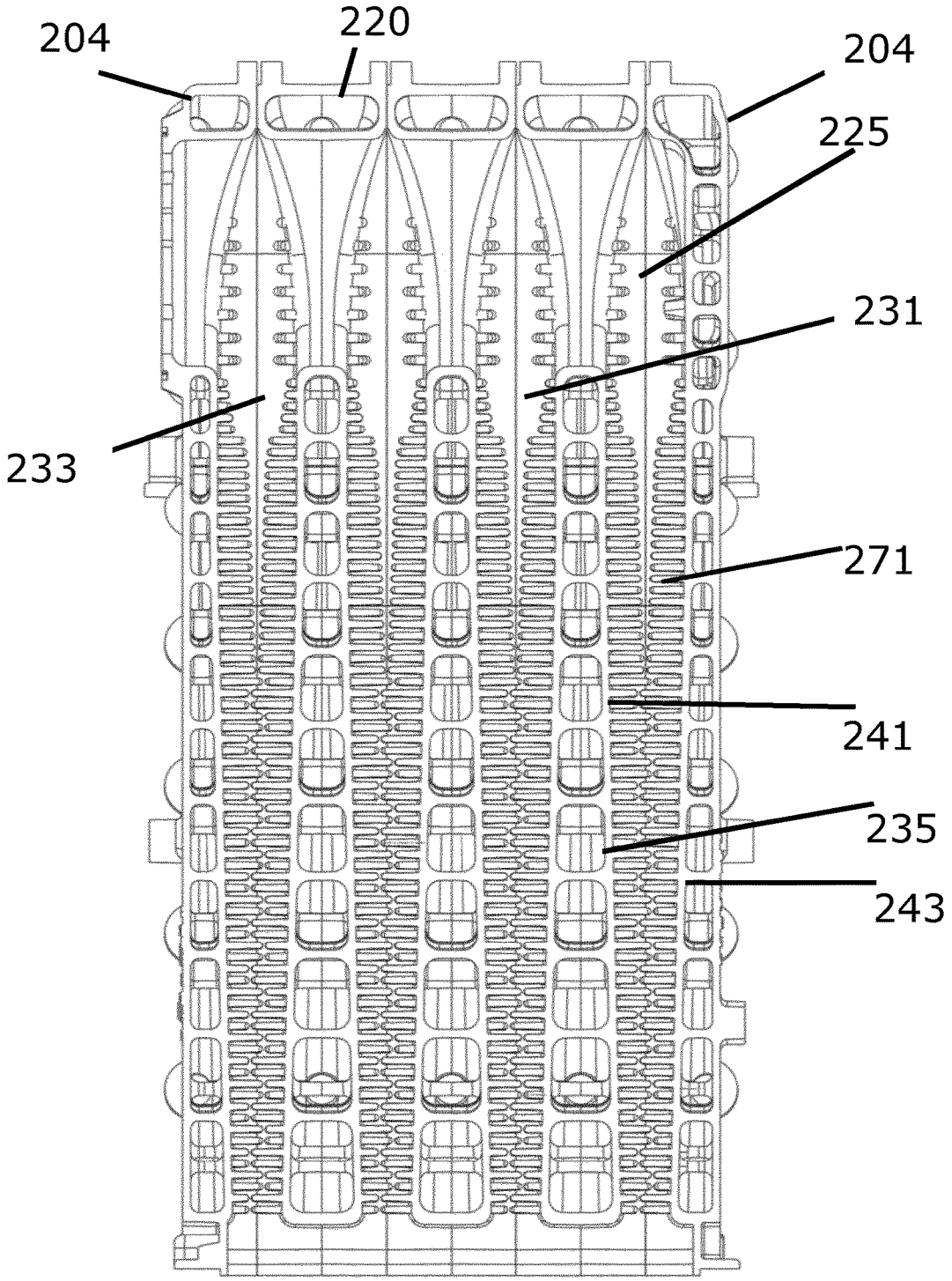
FIG. 2 shows a cross section in the longitudinal direction of the combustion chamber of a sectional heat exchanger according to the invention.
Figure 3:
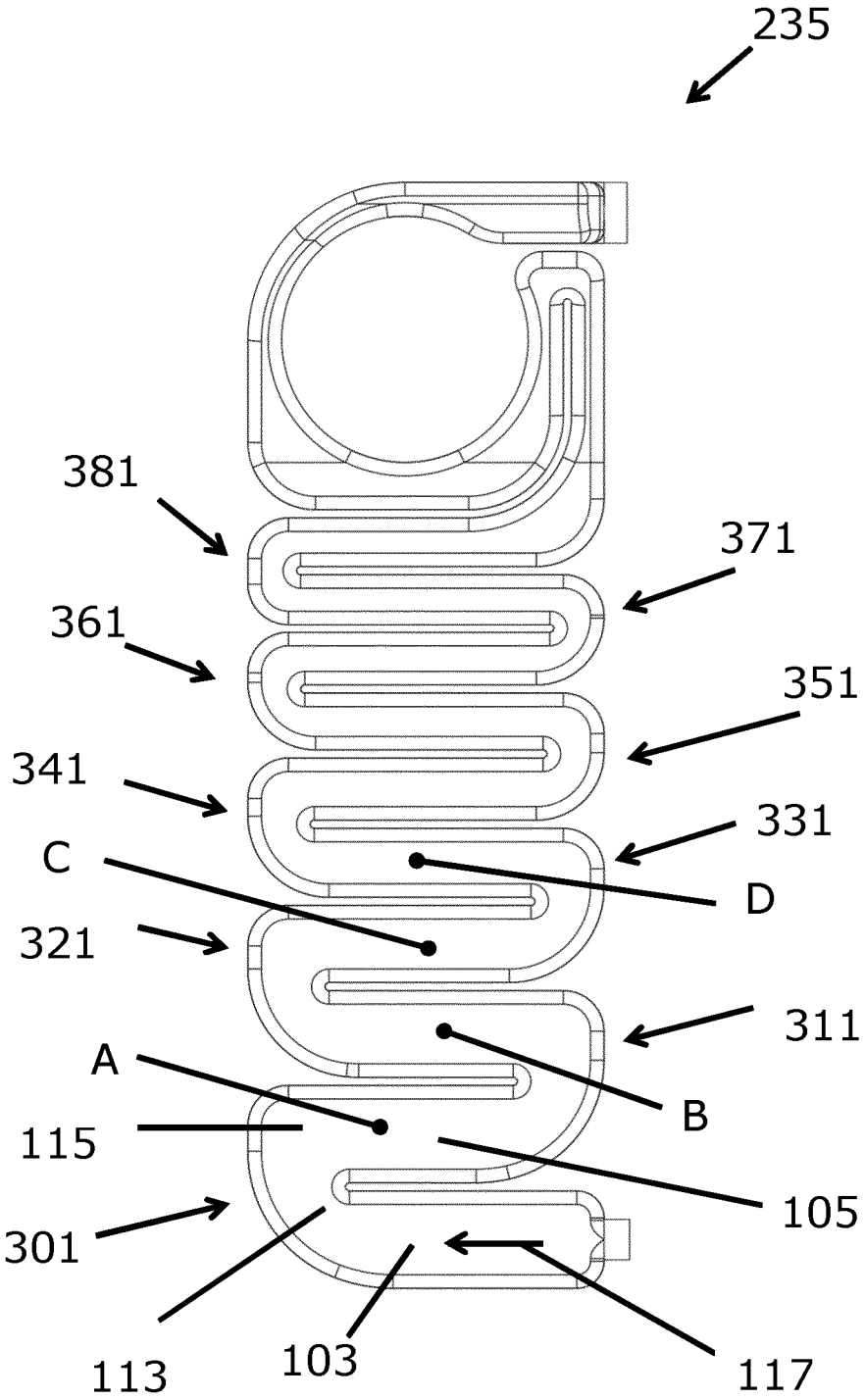
FIG. 3 shows a cross section of a water flow channel, perpendicularly to the combustion chamber of a sectional heat exchanger according to the invention.
Figure 4:
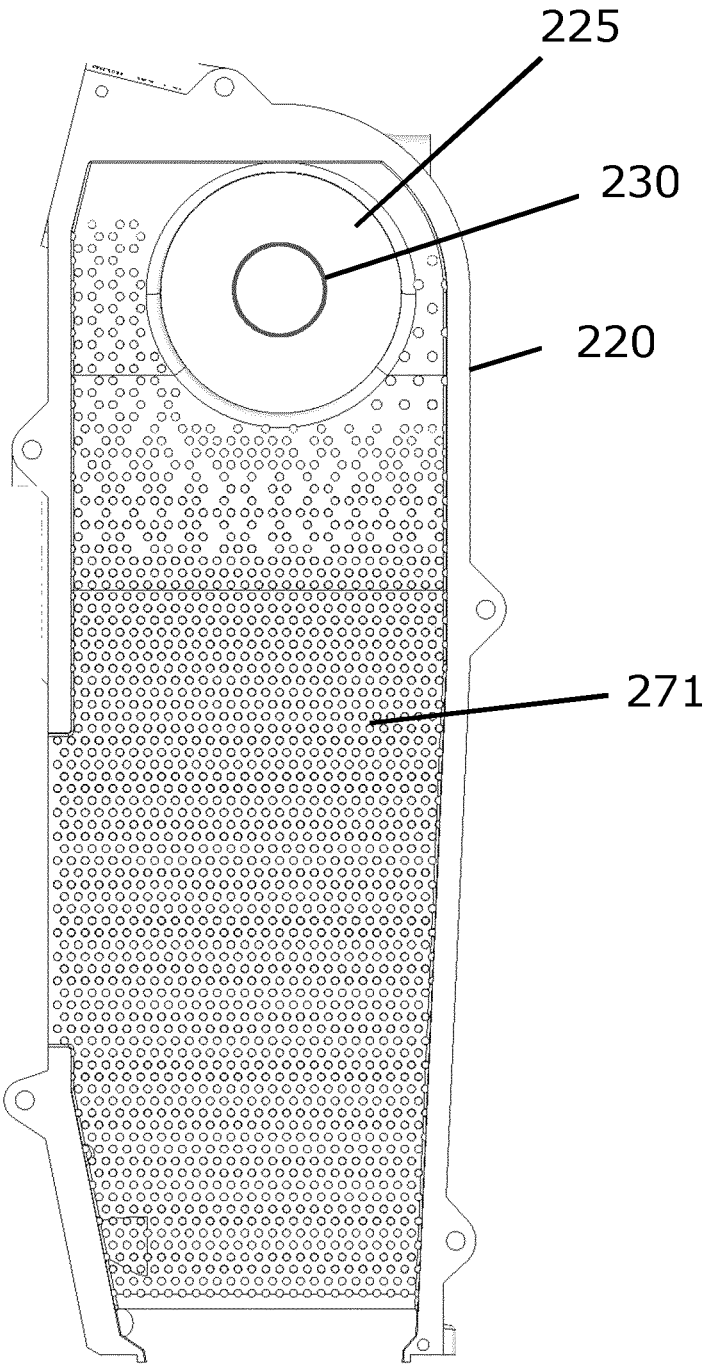
FIG. 4 shows a cross section in between two segments, perpendicularly to the combustion chamber, of a sectional heat exchanger according to the invention.

FIGS. 2, 3 and 4 show cross sections of a sectional heat exchanger according to the invention. FIG. 2 shows a cross section in the longitudinal direction of the combustion chamber 225 of a sectional heat exchanger according to the invention. FIG. 3 shows a cross section of a water flow channel 235, perpendicularly to the combustion chamber of a sectional heat exchanger according to the invention. FIG. 4 shows a cross section in between two segments, perpendicularly to the combustion chamber 225, of a sectional heat exchanger according to the invention.

The exemplary sectional heat exchanger comprises two end segments 204 and three intermediate segments 220 provided between the two end segments 204. The three intermediate segments 220 and the two end segments 204 are assembled in the heat exchanger. A combustion chamber 225 is provided in the sectional heat exchanger, perpendicular to the one or more intermediate segment(s) 220. The intermediate segments 220 and the end segments 204 can be made via aluminum casting. A burner, e.g. a cylindrical premix burner 230 (shown in FIG. 4, not shown in FIG. 2) can be installed in the combustion chamber 225, thereby forming a heat cell comprising the sectional heat exchanger and the burner 230. In a preferred embodiment, a burner is used with a straight longitudinal axis aligned with the straight longitudinal axis of the combustion chamber 225.

Each of the three intermediate segments 220 comprise a water flow channel 235 for water to be heated. In between each two consecutive segments (end segments 204 or intermediate segments 220) a gas flow channel 231, 233 for flue gas is present. The gas flow channels 231, 233 extend from at the combustion chamber 225, allowing flue gas generated in the combustion chamber 225 by a burner 230 to flow from the combustion chamber 225 through the flow channels 231, 233 for flue gas.

The aluminum walls 241, 243 of the intermediate segments 220 and of the end segments 204 between the at least one water channel 235 and the gas flow channel 231, 233 can be provided with means—e.g. pins 271 extending from the walls 241, 243 into the flue gas channel 231, 233—to increase the heat transfer between hot flue gas and water.

In the example, the water flow channels 235 of the end segments 204 and of the intermediate segments 220 are connected in parallel flow connection.

In the example, the water flow channels 235 in the intermediate segments 220 and in the end segments 204 are provided for counter flow of the water to be heated with respect to the flow direction of flue gas in the flue gas channels 231, 233.

In the exemplary sectional heat exchanger according to the invention, the intermediate segments 220 and the two end segments 204 comprise each a water flow channel 235 comprising a number of consecutive parallel straight segments, wherein two consecutive parallel straight segments 103, 105 are separated by a wall and by a U-turn (301, 311, 321, 331, 341, 351, 361, 371, 381). The wall separating the two consecutive parallel straight segments 103, 105 of the water flow channel is a common aluminum wall. The water flow direction is indicated by means of arrow 117. The U-turn comprises an upstream section 113 and a downstream section 115, wherein the upstream 113 and the downstream 115 sections are defined as the sections of the U-turn delimited on the one hand by the plane of the wall separating the two consecutive parallel straight segments; and on the other hand by the plane through the end section of the wall separating consecutive parallel straight segments, the plane which is parallel with the width direction of the water flow channel and which is perpendicular to the plane of the wall separating consecutive parallel straight segments. The upstream section 113 is located in the upstream part of the U-turn; and the downstream section 115 is located in the downstream part of the U-turn. The water channel 235 of the exemplary heat exchanger has—in downstream direction of the water flow—a number of consecutive U-turns 301, 311, 321, 331, 341, 351, 361, 371 and 381.

The relative difference of the upstream section of the U-turn compared to the downstream section of the U-turn (the relative difference is defined as the volume of the downstream section minus the volume of the upstream section, divided by the volume of the downstream section, and expressed as a percentage) is for the first U-turn 301: 30%
for the second U-turn 311: 37%
for the third U-turn 321: 37%
for the fourth U-turn 331: 28%
for the fifth U-turn 341: 14%
for the sixth U-turn 351: 4%
for the seventh U-turn 361: 2%
for the eight U-turn 371: −1%
for the ninth U-turn 381: −14%

Table I lists the dimensions of the consecutive parallel straight segments of the exemplary inventive heat exchanger. The parallel straight segments of this example have a rectangular cross section.

TABLE I dimensions of the consecutive parallel straight segments of an exemplary inventive heat exchanger (Parallel straight segment number 1 is the parallel straight segment most upstream in the heat exchanger, parallel straight segment number 2 is the parallel straight segment immediately downstream of parallel straight segment number 1, and so on)

| Parallel straight segment number | Height of segment (mm) | Width of segment (mm) | Surface area of cross section ($mm^2$) |
|---|---|---|---|
| 1 | 67 | 45 | 3010 |
| 2 | 55 | 42 | 2310 |
| 3 | 52 | 40 | 2080 |
| 4 | 51 | 37 | 1890 |
| 5 | 50 | 35 | 1750 |
| 6 | 49 | 32 | 1570 |
| 7 | 48 | 30 | 1440 |
| 8 | 47 | 28 | 1320 |
| 9 | 46 | 25 | 1150 |
| 10 | 45 | 25 | 1120 |
| 11 | 42 | 25 | 1050 |

Table II provides—for the different U-turns in the water flow channel of the exemplary heat exchanger—the values of the smallest radius of curvature R1 of the curved section of the outer part of the upstream section of the U-turn; and the values of the smallest radius of curvature R2 of the curved section of the outer part of the downstream section of the U-turn. R1 and R2 are explained in FIG. 1.

TABLE II

Smallest radius of curvature R1 and R2 (mm) for successive U-turns

| U-turn | R1 (mm) | R2 (mm) |
|---|---|---|
| 1 (301 in FIG. 3) | 100 | 30 |
| 2 (311 in FIG. 3) | 90 | 30 |
| 3 (321 in FIG. 3) | 80 | 30 |
| 4 (331 in FIG. 3) | 70 | 30 |
| 5 (341 in FIG. 3) | 60 | 30 |
| 6 (351 in FIG. 3) | 50 | 30 |
| 7 (361 in FIG. 3) | 50 | 30 |
| 8 (371 in FIG. 3) | 50 | 30 |
| 9 (381 in FIG. 3) | 30 | 30 |

The pressure drop in the water channel 235 of the example of the inventive heat exchanger has been compared with the pressure drop at the same flow rate in a similar heat exchanger, but which has in the U-turns the same volume in the upstream as in the downstream sections:

pressure drop between points A and B (FIG. 3): 82 mbar for the inventive heat exchanger; 101 mbar for the comparative prior art heat exchanger pressure drop between points B and C (FIG. 3): 92 mbar for the inventive heat exchanger; 116 mbar for the comparative prior art heat exchanger pressure drop between points C and D (FIG. 3): 97 mbar for the inventive heat exchanger; 103 mbar for the comparative prior art heat exchanger.

The invention claimed is:

1. A heat exchanger, comprising:

at least one gas flow channel for the flow of hot gas;

at least one water flow channel for the flow of water;

a metal wall delimiting the gas flow channel from the water flow channel, for exchanging heat between the hot gas in the gas flow channel and water in the water flow channel in order to heat the water;

wherein the at least one water flow channel comprises at least three consecutive parallel straight segments, wherein two consecutive parallel straight segments are separated by a wall and by a U-turn;

wherein said U-turn comprises an upstream section and a downstream section, wherein the upstream and the downstream sections are defined as the sections of said U-turn delimited by the plane of the wall separating the two consecutive parallel straight segments and by the plane through the end section of the wall separating the two consecutive parallel straight segments, the plane which is parallel with the width direction of the water flow channel and which is perpendicular to the plane of the wall separating the two consecutive parallel straight segments;

wherein the upstream section is located in the upstream part of said U-turn; and wherein the downstream section is located in the downstream part of said U-turn;

wherein the upstream section of at least two of said U-turns has a volume that is at least 20% lower than the volume of the downstream section;

wherein the width of the parallel straight segment immediately downstream of the U-turn is smaller than the width of the parallel straight segment immediately upstream of the U-turn; and/or wherein the height of the parallel straight segment immediately downstream of the U-turn is smaller than the height of the parallel straight segment immediately upstream of the U-turn.

2. A heat exchanger as in claim 1, wherein the cross sectional area of the parallel straight segment immediately downstream of the U-turn is smaller than the cross section area of the parallel straight segment immediately upstream of the U-turn.

3. A heat exchanger as in claim 1, wherein the cross section of the parallel straight segment immediately downstream of the U-turn is substantially rectangular; and wherein the ratio of a largest side over a smallest side of the substantially rectangular cross section is less than 1.5.

4. A heat exchanger as in claim 1, wherein in a second U-turn in the water flow channel the relative difference in volume between the downstream section and the upstream section is more than 20%, but is smaller than the relative difference in volume between the downstream section and the upstream section in a first U-turn upstream in the water flow channel to the second U-turn; wherein the relative difference is defined as the volume of the downstream section minus the volume of the upstream section, divided by the volume of the downstream section.

5. A heat exchanger as in claim 1, comprising a series of U-turns, wherein in each U-turn in said series of U-turns, the relative difference in volume between the downstream section and the upstream section of the U-turn is more than 20%, and wherein in the series of U-turns the relative difference in volume between the downstream section and the upstream section of the U-turn decreases in downstream direction of the water flow channel.

6. A heat exchanger as in claim 1, wherein the water flow channel comprises downstream of the U-turns wherein the volume of the upstream section is at least 20% lower than the volume of the downstream section, at least one U-turn wherein the upstream section has a substantially equal or a larger volume than the downstream section.

7. A sectional heat exchanger comprising:

two end segments and one or more intermediate segment (s) provided between the two end segments;

the one or more intermediate segment(s) and the two end segments are assembled together, wherein a combustion chamber is provided in the sectional heat exchanger, preferably perpendicular to the one or more intermediate segment(s), each of the one or more intermediate segments comprise at least one water flow channel, between each two consecutive segments at least one gas flow channel is present, and the gas flow channel extends from at the combustion chamber, and wherein at least one intermediate segment comprises at least one water flow channel comprising at least three consecutive parallel straight segments, wherein two consecutive parallel straight segments are separated by a wall and by a U-turn;

wherein said U-turn comprises an upstream section and a downstream section, wherein the upstream and the downstream sections are defined as the sections of said U-turn delimited by the plane of the wall separating consecutive parallel straight segments and by the plane through the end section of the wall separating consecutive parallel straight segments, the plane which is parallel with the width direction of the water flow channel and which is perpendicular to the plane of the wall separating consecutive parallel straight segments;

wherein the upstream section is located in an upstream part of said U-turn; and wherein the downstream section is located in a downstream part of said U-turn;

wherein in at least two U-turns the upstream section has a volume that is at least 20% lower than the volume of the downstream section.

8. A heat exchanger as in claim 1, wherein the heat exchanger is a mono-cast metal heat exchanger.

9. A heat exchanger as in claim 1, further comprising a combustion chamber for the installation of a burner.

10. A heat at exchanger as in claim 1, wherein an outer part of the upstream section of the U-turn comprises a curved section with a smallest radius of curvature R1 and wherein an outer part of the downstream section of the U-turn comprises a curved section with a smallest radius of curvature R2;

wherein the smallest radius of curvature R2 is at least 20 mm; and wherein the ratio of R1/R2 is higher than 1.5.

11. A heat cell comprising a heat exchanger as in claim 1, wherein the heat exchanger comprises a combustion chamber;

and wherein a burner is provided in the combustion chamber of the heat exchanger.

* * * * *